US005812898A

United States Patent [19]

Benker et al.

[11] Patent Number: 5,812,898

[45] Date of Patent: Sep. 22, 1998

[54] COMPENSATING FOR EVAPORATION FROM A PHOTOGRAPHIC PROCESSING VESSEL

[75] Inventors: Gerhard Benker, Icking; Wilfried Hehn, München, both of Germany

[73] Assignee: Agfa-Gevaert AG-Phototechnik, Leverkusen, Germany

[21] Appl. No.: 660,285

[22] Filed: Jun. 7, 1996

[30] Foreign Application Priority Data

Jun. 10, 1995 [DE] Germany ..... 195 21 273.8

[51] Int. Cl.[6] ..... G03D 3/02; G03D 13/00

[52] U.S. Cl. ..... 396/578; 396/626; 396/627

[58] Field of Search ..... 346/604, 626, 346/630, 578, 572, 568, 569, 627; 430/372, 393, 398–400, 434, 430

[56] References Cited

U.S. PATENT DOCUMENTS

| | | | |
|---|---|---|---|
| 4,781,057 | 11/1988 | Hyfantis, Jr. et al. | 73/49.2 |
| 4,937,608 | 6/1990 | Ishikawa et al. | 396/626 |
| 5,124,239 | 6/1992 | Fujita et al. | 430/398 |

FOREIGN PATENT DOCUMENTS

| | | |
|---|---|---|
| 1254959 | 11/1989 | Japan . |
| 1254960 | 11/1989 | Japan . |

*Primary Examiner*—D. Rutledge
*Attorney, Agent, or Firm*—Darby & Darby

[57] ABSTRACT

A system for processing photographic material has a series of processing vessels containing different water-based processing baths. A reference vessel is mounted on one of the processing vessels and serves to compensate for the evaporation of water from the processing vessels. To this end, the reference vessel accommodates a body of water as well as a float switch having an upper contact and a lower contact. The reference vessel and processing vessels are open at the top and a feeding arrangement is provided to admit water into the respective vessels through their open tops. The feeding arrangement includes one or more pumps connected to a control unit which is further connected to the float switch. When evaporation causes the water in the reference vessel to fall to the level of the lower contact of the float switch, the control unit activates the pump or pumps to replace the water lost from each of the vessels by evaporation.

30 Claims, 2 Drawing Sheets

COMPENSATING FOR EVAPORATION FROM A PHOTOGRAPHIC PROCESSING VESSEL

BACKGROUND OF THE INVENTION

The invention relates to a method and an arrangement which can compensate for evaporation from a wet processing vessel.

When exposed photographic film and photographic paper are developed, such photosensitive material is transported through a series of tanks filled with different processing baths. For the development of film, there may be a first tank with a developing bath, a second tank with a bleaching bath, a third tank with a fixing bath and a fourth tank with a stabilizing bath. On the other hand, three tanks containing a developing bath, a bleaching and fixing bath, and a stabilizing bath, respectively, suffice for the development of photographic paper. These developing systems are particularly suitable for so-called minilaboratories since they are designed for installation in areas having no water connections. Developing systems for large laboratories have rinsing tanks between the individual processing tanks.

To hold the dwell times in the processing baths to a minimum, the processing baths are maintained at a relatively high temperature. Consequently, large quantities of water evaporate from the baths leading to increased concentration. In minilaboratories, an operator compensates for evaporation. Before the developing arrangement is switched on in the morning, the operator manually adds water to each tank in an amount based on experience. On the one hand, this method is quite inaccurate while, on the other hand, it does not correct for the evaporation which constantly takes place during the day. Towards the end of the day, the concentrations of the baths may no longer lie within tolerances.

U.S. Pat. No. 4,937,608 discloses a developing system with automatic compensation for evaporation. Air temperature and moisture are measured, as is the temperature of the developing bath, in order to determine the amount of evaporated water with sufficient precision. The measured values are used to determine the quantity of water which must be returned to the bath.

The method taught by U.S. Pat. No. 4,937,608 is expensive because of the number of sensors required. Moreover, this method is imprecise because many more parameters than those measured affect evaporation. For instance, the warm air flowing over the surface of the bath from the dryer has a very strong effect. The exhaust fan for vapors of the developing bath also has a great influence on the evaporation rate.

SUMMARY OF THE INVENTION

It is an object of the invention to provide an arrangement which makes it possible to compensate for evaporated liquid relatively economically.

Another object of the invention is to provide an arrangement which enables evaporated liquid to be compensated for with sufficient accuracy.

An additional object of the invention is to provide a method which allows compensation for evaporated liquid to be achieved relatively inexpensively.

A further object of the invention is to provide a method which permits evaporated liquid to be compensated for with adequate precision.

The preceding objects, as well as others which will become apparent as the description proceeds, are achieved by the invention.

One aspect of the invention resides in an arrangement to compensate for evaporation from a wet processing vessel exposed to predetermined conditions which affect evaporation. The arrangement comprises a reference vessel exposed to approximately the same predetermined conditions as the processing vessel.

The reference vessel is intended to accommodate a body of liquid, preferably water.

The reference vessel eliminates the need for a multiplicity of sensors which would otherwise be required for the measurement of temperature and humidity. Inasmuch as the reference vessel is exposed to the same, or approximately the same, conditions as the processing vessel, the evaporation rates of the two vessels are directly comparable.

The wet processing vessel may constitute part of a processing system and the reference vessel can be incorporated in this system. Advantageously, the reference vessel is placed at a location which, as regards temperature, humidity and air movement, is subjected to the same conditions as the processing vessel. To maintain the water in the reference vessel as nearly as possible at the temperature of the bath in the processing vessel, at least one wall section of the reference vessel can be in direct contact with a wall section of the processing vessel. If the processing vessel is made of plastic, the reference vessel may be of one piece with the processing vessel.

A particularly rapid reaction to temperature changes in the processing bath can be achieved by placing the reference vessel in direct contact with the bath. To this end, the reference vessel can be disposed in the processing vessel or built into a pumping circuit for the processing bath so that the bath flows around the reference vessel.

In past trials, there were always great difficulties in attempting to monitor the level of the processing bath with a float switch. Due to the high concentration of the bath, crystallization took place constantly and affected measurement precision. This problem does not arise with a reference vessel containing water. There is nothing to prevent the monitoring of the level of pure water with an economical float switch.

When a processing system according to the invention is designed to automatically compensate for evaporation, the control unit which regulates filling of the processing vessel should be calibrated. For the purpose of calibration, the system is operated in a standby mode for some interval. Subsequently, the amount of evaporation from the processing vessel and the amount of evaporation from the reference vessel are measured. The ratio of these amounts establishes a calibration factor which determines how much water must be supplied to the processing vessel when a predetermined amount of water has evaporated from the reference vessel.

In a relatively simple embodiment of the processing system of the invention, the reference vessel contains a float switch having a single switch element or operating point. The control unit is designed so that, in response to a specific action such as switching the system on or off, water is fed into the reference vessel until the float reaches the operating point. The quantity of water necessary to replenish the processing vessel is then obtained by multiplying the quantity of water fed into the reference vessel by the calibration factor.

In another embodiment of the processing system in accordance with the invention, a float switch having an upper and a lower contact or switch element is disposed in the reference vessel. Here, refilling of the processing vessel is initiated when the float sinks to the lower contact. The lower contact is set so that the concentration of the processing bath is still within acceptable limits when the water level in the reference vessel has fallen to this point. This embodiment is substantially more accurate than that with a single contact.

It is preferred for the processing vessel and the reference vessel to be automatically refilled at the same time. In a relatively inexpensive embodiment of the processing system according to the invention, a single metering pump feeds water to both the processing vessel and the reference vessel. If different quantities of water must be supplied to the processing vessel and the reference vessel, the two vessels can be connected to the pump via respective pipes or conduits having different cross-sectional areas. Another possibility is to arrange a valve having multiple positions between the pump and the inlets to the processing and reference vessels. Different quantities of water can then be fed to the processing vessel and the reference vessel by regulating the length of time for which the pump communicates with each vessel. The reference vessel is refilled first until the float has risen to the upper contact. The time taken to refill the reference vessel is thereupon multiplied by the calibration factor to yield the time required for refilling of the processing vessel.

An additional embodiment of the processing system in accordance with the invention contains an individual metering pump for the processing vessel and an individual metering pump for the reference vessel. The capacities of the two pumps may be in a ratio established by the calibration factor and, under such circumstances, the pumps can operate for the same length of time. The embodiment with individual pumps for the processing and reference vessels operates with a higher degree of precision than the embodiment having a common pump for the two vessels.

In a processing system containing more than one processing vessel, a single reference vessel generally suffices to compensate for evaporation from all of the processing vessels with the required accuracy.

Another aspect of the invention resides in a method of compensating for evaporation from a wet processing vessel. The method comprises the step of detecting evaporation from a reference source. The reference source preferably comprises a body of water.

The method may further comprise the steps of establishing a ratio from the evaporation rate for the processing vessel and the evaporation rate for the reference source, and calculating the amount of evaporation for the processing vessel from such ratio.

The method can also comprise the step of replenishing the processing vessel. The method may similarly comprise the step of refilling the reference source.

The invention is particularly applicable to a processing system for photographic film and photographic paper.

Additional features and advantages of the invention will be forthcoming from the following detailed description of preferred embodiments when read in conjunction with the accompanying drawings.

DESCRIPTION OF THE PREFERRED EMBODIMENTS

Figure 1:
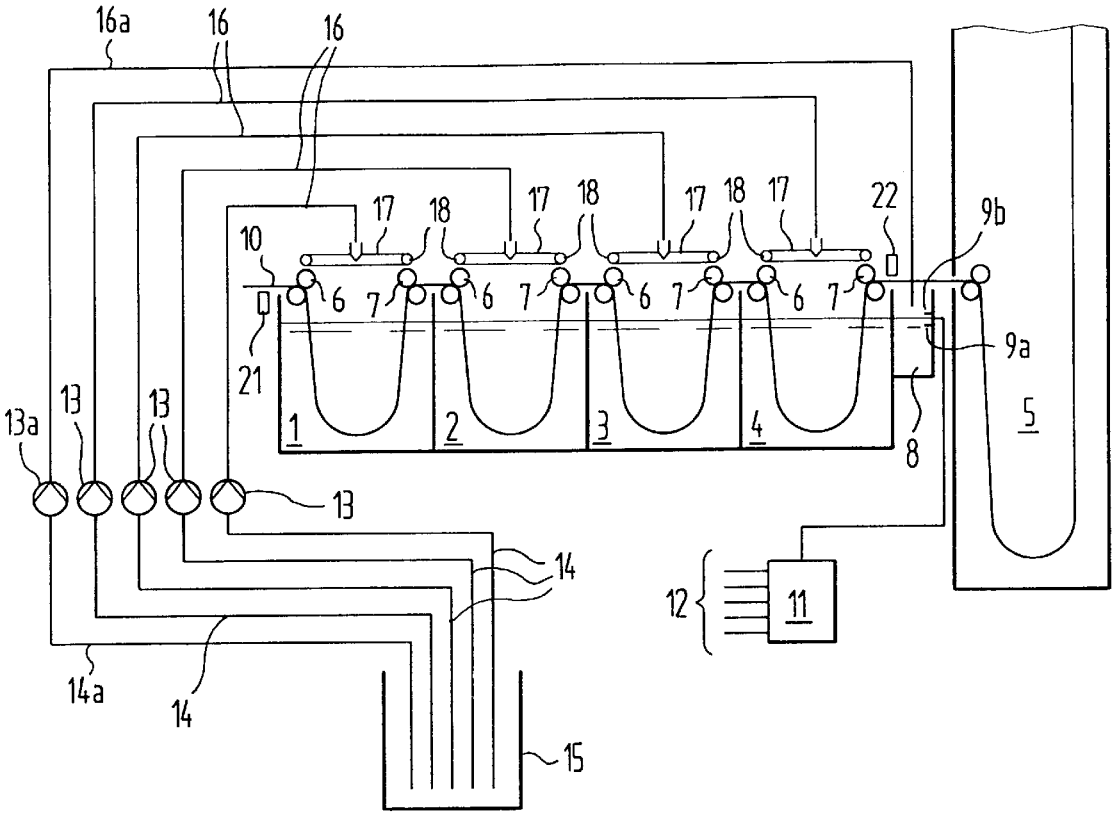
FIG. 1 schematically illustrates one embodiment of a wet processing system in accordance with the invention.

Referring to FIG. 1, a wet processing system in accordance with the invention is shown. The processing system is here assumed to be a developing system for photographic film and includes a wet processing vessel or tank 1 containing a developing bath, a wet processing vessel or tank 2 containing a bleaching bath, a wet processing vessel or tank 3 containing a fixing bath, and a wet processing vessel or tank 4 containing a stabilizing bath. The illustrated processing system, which is primarily intended for minilaboratories, contains no rinsing or washing bath. The developing bath, bleaching bath, fixing bath and stabilizing bath each constitute a processing bath.

A wet processing system similar to that of FIG. 1 can be used for the development of photographic paper. However, a processing system for photographic paper can be designed with only three wet processing vessels or tanks containing a developing bath, a bleaching and fixing bath, and a stabilizing bath, respectively. Such a processing system may again be devoid of a rinsing or washing bath if it is to be used in a minilaboratory.

An elongated filmstrip or band of photographic film, identified by the numeral 10, is transported through the processing vessels 1, 2, 3, 4 successively. A first pair of transport rollers 6 and a second pair of transport rollers 7 are associated with each of the processing vessels 1, 2, 3, 4. The transport rollers 6 are entry rollers serving to draw the filmstrip 10 into the respective processing vessel 1, 2, 3, 4. The transport rollers 7, on the other hand, are discharge rollers which draw the filmstrip 10 out of the corresponding processing vessel 1, 2, 3, 4. Additional rollers may be arranged in the processing vessels 1, 2, 3, 4 but have been omitted from the drawings.

The filmstrip 10 is transported through the processing vessels 1, 2, 3, 4 successively. After leaving the processing vessel 4, the filmstrip 10 enters a hot-air dryer 5 where it is dried.

The processing baths contain water which evaporates over time. This leads to undesirable increases in the concentrations of the baths. To prevent excessive increases in concentration, the processing system is provided with an arrangement designed to compensate for the evaporation of water from the baths.

Figure 2:
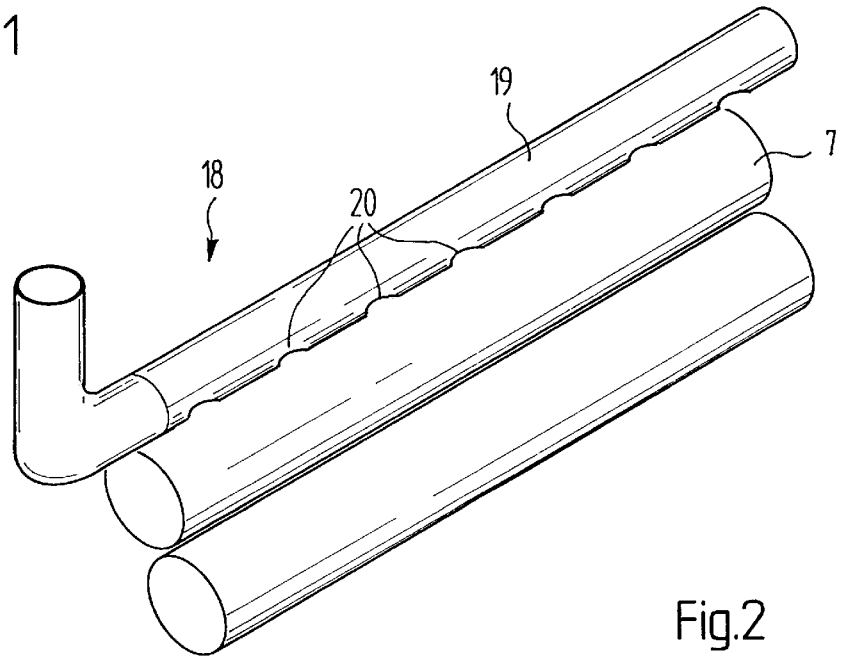
FIG. 2 shows a feed unit for replenishing a wet processing vessel following evaporation.

The compensating arrangement includes a water storage vessel or tank 15. Four metering pumps 13 are arranged to pump water from the storage vessel 15 to respective ones of the processing vessels 1, 2, 3, 4. The pumps 13 draw water from the storage vessel 15 via respective supply pipes or conduits 14. The water drawn from the storage vessel 15 by each of the pumps 13 is pumped through a respective delivery pipe or conduit 16 to a distributor 17. Each of the distributors 17 overlies one of the processing vessels 1, 2, 3, 4 and distributes the incoming water to two discharge elements 18 respectively disposed above the entry rollers 6 and the discharge rollers 7 of the corresponding processing vessel 1, 2, 3, 4. The discharge elements 18 are advantageously designed so that the outflowing water is distributed over the rollers 6, 7. In a film developing system such as that of FIG. 1, the rollers 6, 7 are relatively small. Thus, an adequate distribution of water can be obtained with discharge elements 18 constituted by hoses or pipes having open ends. However, for a paper developing system where the rollers 6, 7 are relatively large, the discharge elements 18 are preferably in the form shown in FIG. 2. Here, each of the discharge elements 18 comprises a pipe or pipe section 19 which is parallel to the longitudinal axes of the rollers 6,7. The surface portion of a pipe 19 which faces the respective rollers 6, 7 is provided with a series of apertures 20 which are spaced from one another longitudinally of the pipe 19.

This enables a uniform distribution of water over the rollers 6, 7 to be achieved.

The pipes 16, distributors 17 and discharge elements 18 can be considered to constitute a means for replenishing the processing vessels 1, 2, 3, 4.

The compensating arrangement further includes a reference vessel or tank 8 which is directly mounted on the processing vessel 4 and contains a body of water. The processing vessel 4 is exposed to certain conditions which affect the evaporation of water from the processing vessel 4, and the reference vessel 8 is arranged so that it is exposed to the same conditions. Among the factors which affect evaporation from the processing vessel 4 is hot air which escapes from the dryer 5 and flows over the processing vessel 4, and the reference vessel 8 is situated where the hot air can flow over the reference vessel 8 also. Accordingly, hot air which escapes from the dryer 5 and flows towards the reference vessel 8 and the processing vessel 4 has a similar effect on the reference vessel 8 and the processing vessel 4.

A metering pump 13*a* is arranged to pump water from the storage vessel 15 to the reference vessel 8. The pump 13*a* draws water from the storage vessel 15 via a supply pipe or conduit 14*a*. The water drawn from the storage vessel 15 by the pump 13*a* is pumped through a delivery pipe or conduit 16*a* into the reference vessel 8. The pipe 16*a* constitutes a means for refilling the reference vessel 8.

A float switch or sensing unit is located in the reference vessel 8 and has a lower contact or switch element 9*a* corresponding to a lower water level and an upper contact or switch element 9*b* corresponding to an upper water level. The float switch 9*a*, 9*b* is connected to a control unit 11 which regulates the metering pumps 13, 13*a* by way of conductors 12.

During operation of the developing system, water evaporates from the processing vessels 1, 2, 3, 4 and the reference vessel 8. When the water in the reference vessel 8 falls to the level of the lower contact 9*a*, the float switch 9*a*, 9*b* sends a signal to the control unit 11. The control unit 11, in turn, activates the pumps 13,13*a* to refill or replenish the processing vessels 1, 2, 3, 4 and the reference vessel 8. This compensates for the evaporation which has taken place from the processing vessels 1, 2, 3, 4.

The lower contact 9*a* is disposed at a level such that the concentrations of the processing baths remain within acceptable limits.

In order to properly compensate for evaporation from the processing vessels 1, 2, 3, 4, the processing system must be calibrated. To this end, the developing system is placed in a standby mode during which no film is passed through the developing system. After the developing system has been in the standby mode for some period of time, the amount of evaporation from the reference vessel 8 while the system was in the standby mode is measured. The amount of evaporation from each of the processing vessels 4 is likewise measured. Calibration ratios are established for the processing vessels 1, 2, 3, 4 using the amount of evaporation from the reference vessel 8 and the amounts of evaporation from the respective processing vessels 1, 2, 3, 4. The calibration ratios, which will normally be different from unity, determine how much water must be added to a processing vessel 1, 2, 3, 4 for each unit of water which evaporates from the reference vessel 8.

It is possible to design the developing system so that the capacities of the pumps 13 equal the capacity of the pump 13*a* multiplied by the respective calibration ratios. Under such circumstances, the control unit can be programmed to operate the pumps 13, 13*a* for a specified time period when the water in the reference vessel 8 falls to the level of the lower contact 9*a*. This time period is calculated so that the amount of water pumped into each of the vessels 1, 2, 3, 4, 8 essentially equals the amount of water which evaporated from the respective vessel 1, 2, 3, 4, 8. The upper contact 9*b* then functions to increase safety and to prevent disruptions in operation. Alternatively, the control unit 11 can be programmed to shut off all of the pumps 13, 13*a* when the water in the reference vessel 8 rises to the level of the upper contact 9*b*. In either case, the pumps 13,13*a* operate for the same length of time.

From a cost standpoint, however, it is advantageous for the pumps 13, 13*a* to have the same capacity. Here, the length of time for which the pump 13*a* must operate to replace the evaporated water in the reference vessel 8 differs from the lengths of time for which the pumps 13 must operate to replace the evaporated water in the processing vessels 1, 2, 3, 4. Thus, the pump 13*a* has a predetermined operating time and each of the pumps 13 has a different operating time which equals the operating time for the pump 13*a* multiplied by the calibration ratio for the respective processing vessel 1, 2, 3, 4. These operating times are stored in the control unit 11. When the water in the reference vessel 8 drops to the level of the lower contact 9*a*, the control unit 11 activates the pumps 13, 13*a* for the respective operating times. The upper contact 9*b* again functions as a safety device and to prevent disruptions in operation.

Instead of storing the operating times for the pumps 13, 13*a* in the control unit 11, the calibration factors can be stored. As before, the control unit 11 switches on all of the pumps 13, 13*a* in response to a drop in the water level of the reference vessel 8 to the lower contact 9*a*. The control unit 11 clocks the time required for the water level in the reference vessel 8 to reach the upper contact 9*b* and thereupon switches off the pump 13*a* for the reference vessel 8. Using the respective calibration ratios and the time it took for the water in the reference vessel 8 to reach the upper contact 9*b*, the control unit 11 then calculates the operating periods for the pumps 13, i.e., the lengths of time for which the pumps 13 must operate to refill the respective processing vessels 1, 2, 3, 4. The control unit 11 shuts off each of the pumps 13 individually when the respective operating period expires.

Figure 3:
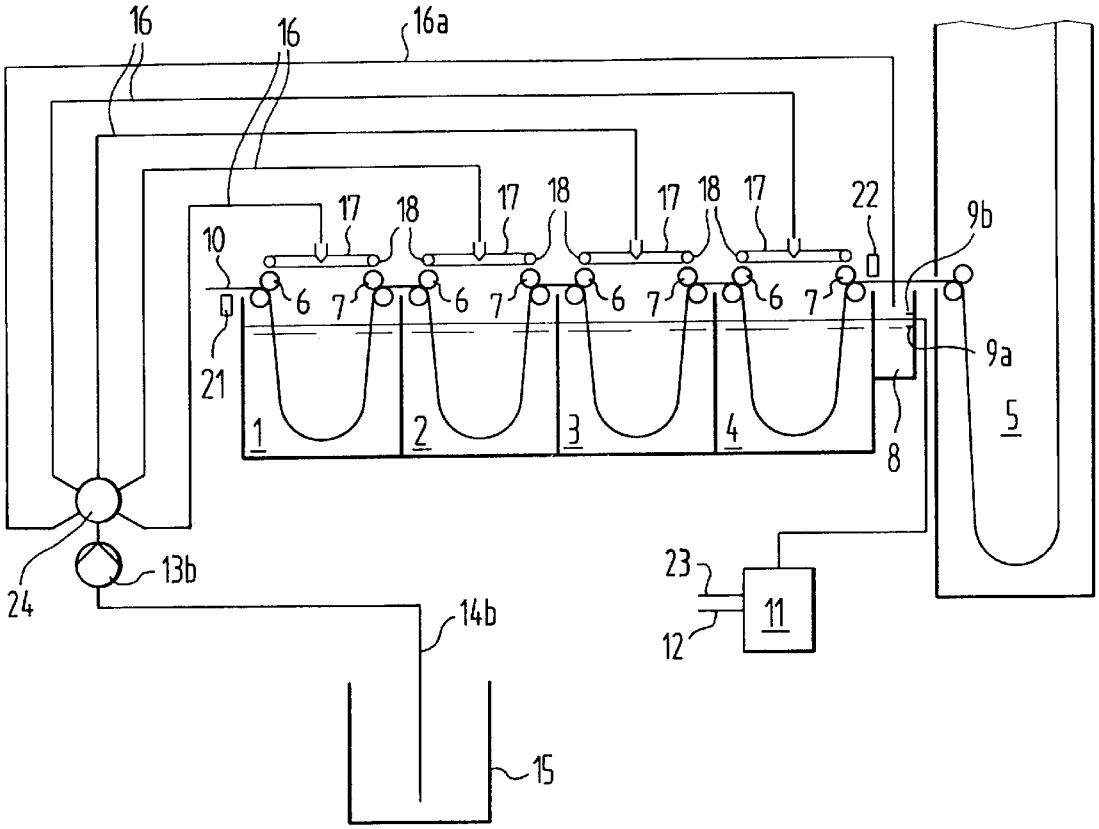
FIG. 3 schematically illustrates another embodiment of a wet processing system according to the invention.

Another embodiment of the developing system is shown in FIG. 3 where the same reference numerals as in FIG. 1 are used to denote identical elements.

In the developing system of FIG. 3, the reference vessel 8 is located inside, and extends into the processing bath within, the processing vessel 4. Furthermore, a single pump 13*b* feeds all of the processing vessels 1, 2, 3, 4 as well as the reference vessel 8. The pump 13*b* is connected to the water storage vessel 15 by a supply pipe or conduit 14*b*. A valve 24 having multiple positions is interposed between the pump 13*b* and the delivery pipes 16, 16*a*. The valve 24 is operable by the control unit 11 via a conductor 23 leading from the control unit 11 to the valve 24.

The developing system of FIG. 3 is calibrated in the same manner as that of FIG. 1.

When the water level in the reference vessel 8 of FIG. 3 falls to the lower contact 9*a*, the control unit 11 activates the pump 13*b* and sets the valve 24 so that water is pumped into the reference vessel 8 only. The control unit 11 clocks the time required for the water level in the reference vessel 8 to reach the upper contact 9*b* and thereupon switches the valve 24 to cut off the reference vessel 8 from the pump 13*b*. Using the respective calibration ratios and the time it took for the water in the reference vessel 8 to reach the upper contact 9*b*, the control unit 11 then calculates the refill period for, i.e., the time required to refill, each of the processing vessels 1, 2, 3, 4. The control unit 11 now sets the valve 24 in such a manner that the pump 13*b* delivers water to the processing vessels 1, 2, 3, 4. The control unit 11 breaks the connection between the pump 13*b* and a processing vessel 1, 2, 3, 4 upon expiration of the respective refill period.

The valve 24 and conductor 23 can be eliminated by designing the delivery pipes 16,16*a* with different cross-sectional areas based on the calibration ratios. Here, the reference vessel 8 and the processing vessels 1, 2, 3, 4 are refilled simultaneously. The pump 13*b* is shut off, and refilling of the vessels 1, 2, 3, 4, 8 terminated, when the water in the reference vessel 8 rises to the level of the upper contact 9*b*.

The developing system of FIG. 3 is more economical than that of FIG. 1. Moreover, by placing the reference vessel 8 of FIG. 3 in the processing bath within the processing vessel 4, a particularly rapid reaction to temperature changes in the processing bath can be achieved.

The transport rollers 6, 7 are disposed outside of the processing baths. By situating the discharge elements 18 over the transport rollers 6, 7, the latter are rinsed at intervals. This allows processing fluid deposited on the transport rollers 6, 7 by the filmstrip 10 or otherwise to be removed. Such processing fluid is not lost, however, but is returned to the respective processing bath together with the makeup water. It has been found that regular cleaning of transport rollers, like the transport rollers 6, 7, which lie outside of the processing baths can be virtually eliminated since the salts dissolved in the processing fluids can no longer crystallize out on the rollers.

In order to maintain uniform film quality, the pumps 13, 13*b* should deliver water to the processing vessels 1, 2, 3, 4 only when no film is being conveyed through the processing vessels 1, 2, 3, 4. To this end, a sensor 21 can be disposed upstream of the first set of transport rollers 6 while a sensor 22 is disposed downstream of the last set of transport rollers 7. The sensors 21, 22, which are designed to detect the presence of film, are connected with the control unit 11. The sensors 21, 22 make it possible to determine whether or not film is present in the processing vessels 1, 2, 3, 4. If film is present when the water in the reference vessel 8 drops to the level of the lower contact 9*b*, the control unit 11 delays the delivery of water to the processing vessels 1, 2, 3, 4 until the sensor 22 detects the trailing end of the film.

Certain conventional developing systems have a sensor upstream of the processing vessels only. This sensor detects the introduction of photographic material into the processing vessels and, in response to such detection, the system is switched from a standby mode to an operating mode. When the system is switched to the operating mode, a timer is activated and begins to clock a predetermined time interval sufficient to convey the photographic material through all of the processing vessels. If additional photographic material is introduced into the processing vessels during this interval, the timer is reset and starts timing once more. The system automatically switches back to the standby mode when the timer runs down.

In this type of developing system, it is a simple matter to program the control unit 11 so that water is delivered to the processing vessels 1, 2, 3, 4 only in the standby mode. Here, also, the water is reliably prevented from contacting the film being developed and causing variations in quality.

Various modifications are possible within the meaning and range of equivalence of the appended claims.

We claim:

1. A processing system, comprising a wet processing vessel having an upper end; means for conveying material to be processed through said processing vessel, said conveying means including a conveying element in the region of said upper end; and compensating means to compensate for evaporation from said processing vessel, said compensating means including evaporation reference means, means for replenishing said processing vessel on the basis of data from said reference means, and control means for said replenishing means, said control means including means for preventing replenishment of said processing vessel when material to be processed is in said vessel, and said replenishing means being arranged to discharge onto said conveying element.

2. The system of claim 1, wherein said processing vessel contains a photographic processing bath.

3. The system of claim 1, wherein said reference means comprises a reference vessel, a body of liquid in said reference vessel, and means for detecting said body when said body has a predetermined level.

4. The system of claim 3, wherein said liquid is water.

5. The system of claim 3, wherein said compensating means comprises means for supplying liquid to said replenishing means, said control means regulating said supplying means and being arranged to receive data from said detecting means.

6. The system of claim 5, wherein said supplying means comprises a source of water.

7. The system of claim 5, wherein said control means is programmed to cause delivery of a predetermined quantity of liquid to said processing vessel in response to dropping of said body below said predetermined level.

8. The system of claim 5, further comprising means for starting and stopping said conveying means; and wherein said control means is programmed to cause delivery of a quantity of liquid to said processing vessel in response to starting or stopping of said conveying means, said quantity being a function of the level of said body.

9. The system of claim 3, wherein said compensating means includes means for refilling said reference vessel.

10. The system of claim 9, wherein said compensating means further comprises a first metering pump connected with said replenishing means and a second metering pump connected with said refilling means.

11. The system of claim 10 for use where said processing vessel has a first evaporation rate and said reference vessel has a second evaporation rate, wherein said first pump delivers a first quantity of liquid to said processing vessel during a predetermined time interval and said second pump delivers a second quantity of liquid to said reference vessel during said interval, the ratio of said first quantity to said second quantity being essentially equal to the ratio of said first rate to said second rate.

12. The system of claim 9, wherein said compensating means further comprises a metering pump, and means for selectively connecting said pump with said replenishing means and with said refilling means.

13. The system of claim 1, wherein said reference means comprises a reference vessel, said processing vessel being exposed to conditions which affect evaporation, and said reference vessel being exposed to the same, or approximately the same, conditions.

14. The system of claim 13, wherein said reference vessel is mounted on or in said processing vessel.

15. The system of claim 1, wherein said conveying means defines a predetermined path for material to be processed and said path runs outside said reference means in its entirety.

16. A processing system, comprising a wet processing vessel having an upper end; means for conveying material to be processed into said processing vessel, said conveying means including a conveying element in the region of said upper end; and compensating means to compensate for evaporation from said processing vessel, said compensating means including evaporation reference means, and means for replenishing said processing vessel on the basis of data from said reference means, said replenishing means being arranged to discharge onto said conveying element.

17. The system of claim 16, wherein said processing vessel contains a photographic processing bath.

18. The system of claim 16, wherein said reference means comprises a reference vessel, a body of liquid in said reference vessel, and means for detecting said body when said body has a predetermined level.

19. The system of claim 18, wherein said liquid is water.

20. The system of claim 19, wherein said compensating means comprises means for supplying liquid to said replenishing means, and control means for said supplying means arranged to receive data from said detecting means.

21. The system of claim 20, wherein said supplying means comprises a source of water.

22. The system of claim 20, wherein said control means is programmed to cause delivery of a predetermined quantity of liquid to said processing vessel in response to dropping of said body below said predetermined level.

23. The system of claim 20, further comprising means for starting and stopping said conveying means; and wherein said control means is programmed to cause delivery of a quantity of liquid to said processing vessel in response to starting or stopping of said conveying means, said quantity being a function of the level of said body.

24. The system of claim 23, wherein said compensating means includes means for refilling said reference vessel.

25. The system of claim 24, wherein said compensating means further comprises a first metering pump connected with said replenishing means and a second metering pump connected with said refilling means.

26. The system of claim 25 for use where said processing vessel has a first evaporation rate and said reference vessel has a second evaporation rate, wherein said first pump delivers a first quantity of liquid to said processing vessel during a predetermined time interval and said second pump delivers a second quantity of liquid to said reference vessel during said interval, the ratio of said first quantity to said second quantity being essentially equal to the ratio of said first rate to said second rate.

27. The system of claim 24, wherein said compensating means further comprises a metering pump, and means for selectively connecting said pump with said replenishing means and with said refilling means.

28. The system of claim 16, wherein said reference means comprises a reference vessel, said processing vessel being exposed to conditions which affect evaporation, and said reference vessel being exposed to the same, or approximately the same, conditions.

29. The system of claim 28, wherein said reference vessel is mounted on or in said processing vessel.

30. The system of claim 16, wherein said conveying means defines a path for material to be processed and said path runs outside of said reference means in its entirety.

* * * * *